US009664045B2

(12) United States Patent
Mina et al.

(10) Patent No.: US 9,664,045 B2
(45) Date of Patent: May 30, 2017

(54) FACETED FASTENER DRIVER BUMPER WITH COOLING SLOTS

(71) Applicant: ILLINOIS TOOL WORKS INC., Glenview, IL (US)

(72) Inventors: Nathan Thomas Mina, Lake in the Hills, IL (US); James Louis Kuhnwald, Richmond, IL (US)

(73) Assignee: Illinois Tool Works Inc., Glenview, IL (US)

( * ) Notice: Subject to any disclaimer, the term of this patent is extended or adjusted under 35 U.S.C. 154(b) by 289 days.

(21) Appl. No.: 14/469,094

(22) Filed: Aug. 26, 2014

(65) Prior Publication Data

US 2015/0135946 A1 May 21, 2015

Related U.S. Application Data

(60) Provisional application No. 61/905,563, filed on Nov. 18, 2013.

(51) Int. Cl.

| | |
|---|---|
| ***F01B 11/02*** | (2006.01) |
| ***B25C 1/04*** | (2006.01) |
| ***B25C 1/08*** | (2006.01) |

(52) U.S. Cl.

CPC ..... *F01B 11/02* (2013.01); *B25C 1/041* (2013.01); *B25C 1/047* (2013.01); *B25C 1/08* (2013.01)

(58) Field of Classification Search

CPC ..... B25B 21/023; B25C 1/04; B25C 1/041; B25C 1/047; B25C 1/08; B25C 1/14; F01B 11/02

See application file for complete search history.

(56) References Cited

U.S. PATENT DOCUMENTS

| | | | |
|---|---|---|---|
| 2,727,551 | A | 12/1955 | Rees |
| 3,522,830 | A | 8/1970 | Blizard |
| 4,019,550 | A | 4/1977 | DeHaitre |
| 4,403,722 | A | 9/1983 | Nikolich |
| 4,483,473 | A | 11/1984 | Wagdy |
| 4,483,474 | A | 11/1984 | Nikolich |
| 4,522,162 | A | 6/1985 | Nikolich |
| RE32,452 | E | 7/1987 | Nikolich |

(Continued)

FOREIGN PATENT DOCUMENTS

| | | |
|---|---|---|
| DE | 2510858 | 9/1976 |
| EP | 2 103 387 | 9/2009 |

(Continued)

OTHER PUBLICATIONS

Translation of JP 2007 075916 A: Arata et al., Mar. 29, 2007, Japan.*

(Continued)

*Primary Examiner* — Logan Kraft

(74) *Attorney, Agent, or Firm* — Neal, Gerber & Eisenberg LLP

(57) ABSTRACT

A bumper sized to fit a cylinder of a fastener driving tool includes a side profile of the bumper defined by a plurality of flat regions and a plurality of convex regions around an outer periphery of the bumper. Included in the bumper are an inner peripheral surface and an outer peripheral surface. The flat and convex regions are disposed on the outer peripheral surface of the bumper in an alternating pattern.

15 Claims, 9 Drawing Sheets

(56) References Cited

U.S. PATENT DOCUMENTS

| | | | | |
|---|---|---|---|---|
| 4,932,480 | A * | 6/1990 | Golsch | B25C 1/047 173/210 |
| D311,131 | S | 10/1990 | Saito | |
| 5,025,971 | A | 6/1991 | Schafer et al. | |
| D332,568 | S | 1/1993 | Ozawa | |
| 5,197,646 | A * | 3/1993 | Nikolich | B25C 1/008 123/46 SC |
| 5,263,439 | A | 11/1993 | Doherty et al. | |
| D364,179 | S | 11/1995 | Brush | |
| D423,527 | S | 4/2000 | Sakamaki | |
| 6,145,724 | A | 11/2000 | Shkolnikov et al. | |
| D459,207 | S | 6/2002 | Miyata | |
| D507,166 | S | 7/2005 | Chen | |
| D542,814 | S | 5/2007 | Concari | |
| D551,972 | S | 10/2007 | Jacobs et al. | |
| 7,341,171 | B2 | 3/2008 | Moeller et al. | |
| D572,559 | S | 7/2008 | Demers et al. | |
| 7,975,777 | B2 * | 7/2011 | Krondorfer | B25C 1/047 173/206 |
| D646,154 | S | 10/2011 | Andersson | |
| D654,421 | S | 2/2012 | Sugiyama et al. | |
| 8,210,783 | B2 | 7/2012 | Morrison | |
| D679,988 | S | 4/2013 | Yamazaki | |
| D685,245 | S | 7/2013 | Tirone et al. | |
| 2006/0169736 | A1 | 8/2006 | Wen | |
| 2010/0155097 | A1 | 6/2010 | Krondorfer et al. | |
| 2010/0243286 | A1 | 9/2010 | Hoshino et al. | |
| 2012/0223120 | A1 | 9/2012 | Mina | |
| 2013/0206811 | A1 | 8/2013 | Zhao et al. | |

FOREIGN PATENT DOCUMENTS

| | | |
|---|---|---|
| EP | 2 199 026 | 6/2010 |
| FR | 2239320 | 2/1975 |
| JP | 2007 075916 | 3/2007 |

OTHER PUBLICATIONS

"How to Install a Driver Maintenance Kit on a Porter Cable Nail Gun." Replacement Parts., Aug. 18, 2011 [online], [retrieved on Mar. 8, 2016]. Retrieved from the Internet <URL: https://www.ereplacementparts.com/article/7164/How_to_Install_a_Driver_Main_tenance_Kit_on_a_Porter_Cable_Nail_Gun.html>.

"Cheat Guide Chart for Fasteners—Bolts, Screws, Washers, Nuts, and Drive Identification Charts Read." Remove and Replace., Dec. 20, 2013 [online], [retrieved on Mar. 8, 2016]. Retrieved from the Internet <URL: https ://removeandreplace.com/2013/12/20/cheat-guide-chart-for-fasteners-bolts-screws -washers-nuts-and-drive-identiftcation-charts/>.

"The Benefits of Stainless Steel Fasteners." After School Activities Blog., Apr. 17, 2012 [online], [retrieved on Mar. 8, 2016]. Retrieved from the Internet <URL: http://afterschoolachtivities.blogspot.com/2012/04/benefits-of-stainless-steel-fasteners.html>.

"Zipp Track Lock Nuts." World Class Cycles., Dec. 12, 2007 [online], [retrieved on Mar. 8, 2016]. Retrieved from the Internet <URL: http://www.worldclasscycles.com/zipp_track_lock_nuts.htm>.

International Search Report and Written Opinion for International Application No. PCT/US2014/065480, mailed Mar. 3, 2015 (8 pages).

* cited by examiner

FACETED FASTENER DRIVER BUMPER WITH COOLING SLOTS

RELATED APPLICATION

This application claims priority under 35 USC 119(e) from U.S. Provisional Application No. 61/905,563 filed Nov. 18, 2013.

BACKGROUND

The present disclosure generally relates to fastener-driving tools for driving fasteners into workpieces, and more particularly relates to pneumatic-powered fastener-driving tools, also referred to as pneumatic tools or pneumatic nailers.

Fastening tools, and particularly those being pneumatically powered, incorporate a housing enclosing a cylinder. Slidably mounted within the cylinder is a piston assembly in communication on one side with a supply chamber and a return chamber on the opposite side thereof. The piston assembly includes a piston head and a rigid driver blade that is disposed within the cylinder. A movable valve plunger is oriented above the piston head. In its at-rest position, this valve plunger prevents the drive chamber from communicating to the piston assembly and allows an air flow path to atmosphere above the piston assembly. In its actuated state, the valve plunger prevents or blocks the air flow path to atmosphere and allows an air flow path to the drive chamber. Exemplary pneumatic nailers, are disclosed in commonly assigned U.S. Pat. No. 4,932,480, and U.S. Patent Application Publication Nos. 2012/0223120 and 2013/0206811; all of which are incorporated by reference.

Combustion powered fastener driving tools also employ a housing having a cylinder with a reciprocating piston and driver blade. Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 6,145,724 and 7,341,171, all of which are incorporated by reference herein.

When a tool's actuation requirements have been met, the movable valve plunger opens and exposes one side of the piston assembly to a compressed gas energy source. The resulting pressure differential causes the piston and driver blade to be actuated downwardly to impact a positioned fastener and drive it into a workpiece. Fasteners are fed into the nosepiece from a supply assembly, such as a magazine, where they are held in a properly positioned orientation for receiving the impact of the driver blade.

As the piston is actuated downwardly, it drives the air inside the cylinder through a series of vents into the return chamber increasing the pressure in this chamber. After the fastening event has taken place, the valve plunger moves back to the at-rest position, blocking the supply chamber's air flow path to the piston head and releasing the pressure above the piston head through the path to atmosphere. At this time, the pressure built in the return chamber pushes the piston assembly back up towards the top of the cylinder. The air above the piston head is forced through the valve plunger's air flowpath to atmosphere.

Conventionally, both pneumatic and combustion powered fastening tools include a resilient or elastomeric bumper for arresting axial movement of the piston in a driving stroke. As the piston reciprocates within the cylinder for driving the fasteners into the workpieces, the bumper is repeatedly engaged by the piston, thereby affecting its response to heavy impacts, and air circulation along its outer surfaces. Such a bumper requires high tensile strength, high endurance to breakage, high tear strength, high fatigue strength, and low changes in elasticity over a wide range of operating temperatures, e.g., ranging from about −20° F. to about 200° F.

Heat is generated by internal friction due to the repeated heavy impacts of the piston on the bumper. As is known in the art, multiple slots and bores of various shapes are provided for cooling the bumper during operation. Although some heat build-up and impact-related fatigue can be reduced by the slots and bores, some conventional bumpers exhibit breakage and collapse after prolonged use, all of which prevent an adequate blade return during cycling of the piston. Therefore, there is a need for improving the bumper that provides a better cooling design while upholding the overall bumper rigidity and durability.

SUMMARY

The present disclosure is directed to a fastener-driving tool having an air-cooled bumper. Along with the bumper, the present driving tool includes a cylinder, a piston movable axially within the cylinder, and a driver blade movable with the piston. The driver blade moves through a central opening of the bumper and through a central aperture of a nosepiece seal during reciprocal actuations of the piston along the cylinder. While the present bumper is described in relation to a pneumatic nailer, it is also contemplated that such features may also be employed in a combustion powered nailer.

One aspect of the present bumper is that an outer profile of the present bumper is defined by alternating flat or planar surfaces juxtaposed by adjacent convex surfaces, consisting of an odd number of features. More specifically, a side profile of the present bumper has an arrangement of the alternating flat and convex surfaces around an entire periphery of the bumper, excluding an upper portion along an exterior angled leading edge that gradually axially increases the overall profile of the bumper. This faceted bumper has a specific geometric arrangement and maintains the Von Mises and maximum principal stresses within a tolerable range of linear elasticity during operation.

Another important aspect is that a plurality of cooling slots is positioned at a bottom portion of the present bumper for air ventilation, and stress reduction during operation. Each cooling slot extends radially from an inner peripheral surface of the central opening, and also extends axially or vertically at one end of the radial cooling slot toward the exterior angled leading edge and forms a blind closed end. The cooling slots are in fluid communication with the central opening, such that air can be drawn from the cylinder to each slot for cooling the bumper during cycling of the piston. In the present bumper, structural integrity of the inner diameter is maintained due to the location of the cooling slots, thereby preventing collapsing of the bumper after repeated and extensive use.

In a preferred embodiment, a bumper sized to fit a cylinder of a fastener driving tool includes a side profile of the bumper defined by a plurality of flat regions and a plurality of convex regions around an outer periphery of the bumper. Included in the bumper are an inner peripheral surface and an outer peripheral surface. The flat and convex regions are disposed on the outer peripheral surface of the bumper in an alternating pattern.

DETAILED DESCRIPTION

Figure 1:
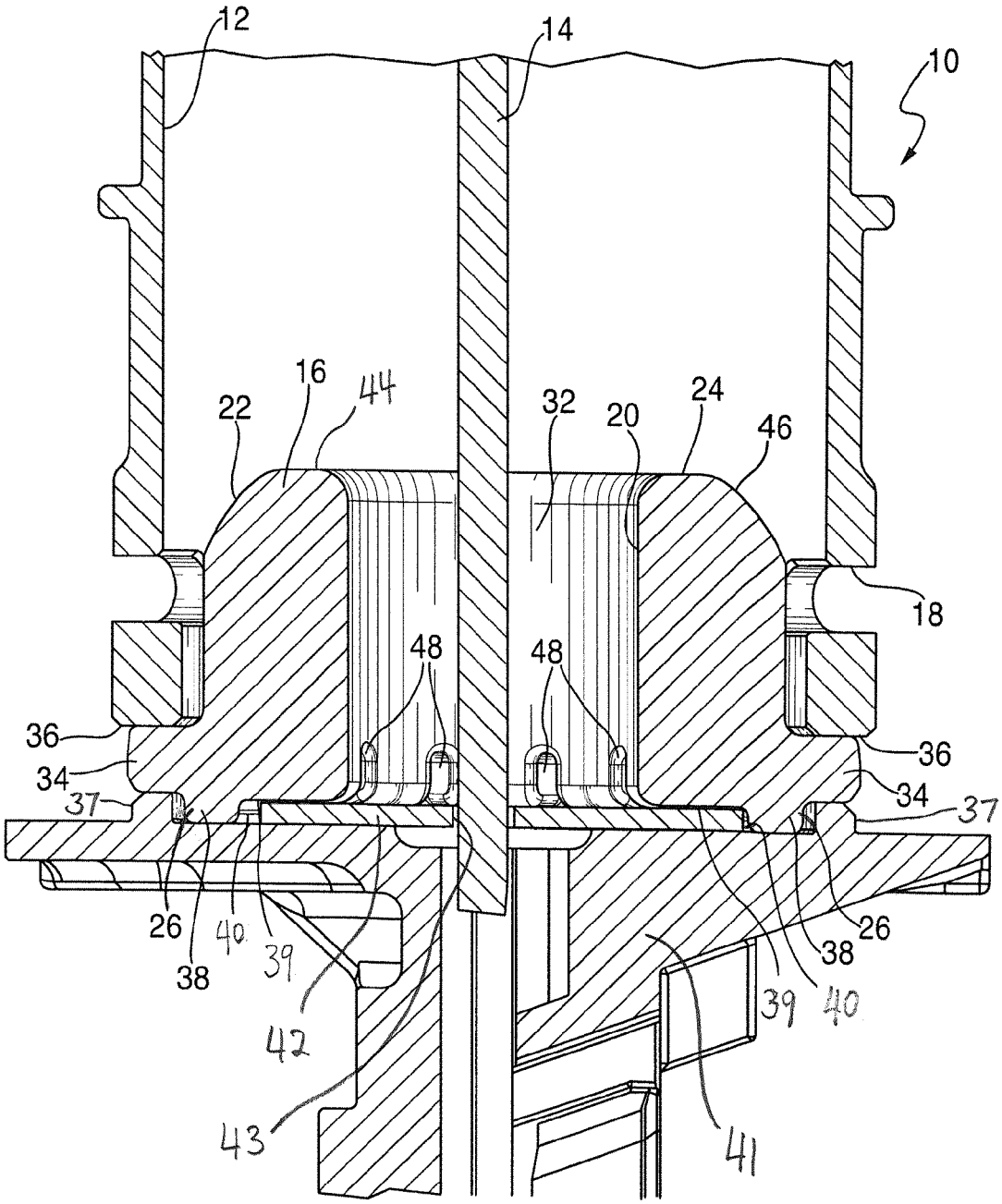
FIG. 1 is a fragmentary vertical section of the present pneumatic fastening tool, featuring the present faceted bumper.

Referring now to FIG. 1, there is fragmentarily illustrated a pneumatic fastener driving tool, generally designated 10, which includes a cylinder 12, a driver blade 14 attached to a piston assembly (not shown), and a bumper 16 sized to fit within the cylinder. General features of the driving tool 10 are known in the art. An exemplary driving tool, such as a pneumatic nailer, is disclosed in commonly assigned U.S. Pat. No. 4,932,480, and U.S. Patent Application Publication Nos. 2012/0223120 and 2013/0206811; all of which are incorporated by reference. As mentioned above, it is also contemplated that the present bumper 16 is employable in a combustion powered tool.

In a preferred embodiment, the driving tool 10 includes a plurality of outlet ports 18 defined by the cylinder 12 for exchanging air during reciprocal movement of the driver blade 14 in the cylinder. A spaced array of outlet ports 18 is provided around the cylinder 12, and the shape of the ports, preferably oval, may vary to suit the situation. As the piston assembly travels downwardly toward the bottom of the cylinder 12, the air in the cylinder escapes through the ports 18, and the piston assembly will impact the bumper 16, causing it to be compressed and stressed. With conventional bumpers, after repeated and extensive use of the tool 10, a shock absorbing performance of the bumper 16 deteriorates, and a structural integrity or rigidity of the bumper is also compromised. Further, heat generated by internal material friction due to the repeated impacts on the bumper 16 shortens the working lifespan of the bumper.

Figure 2:
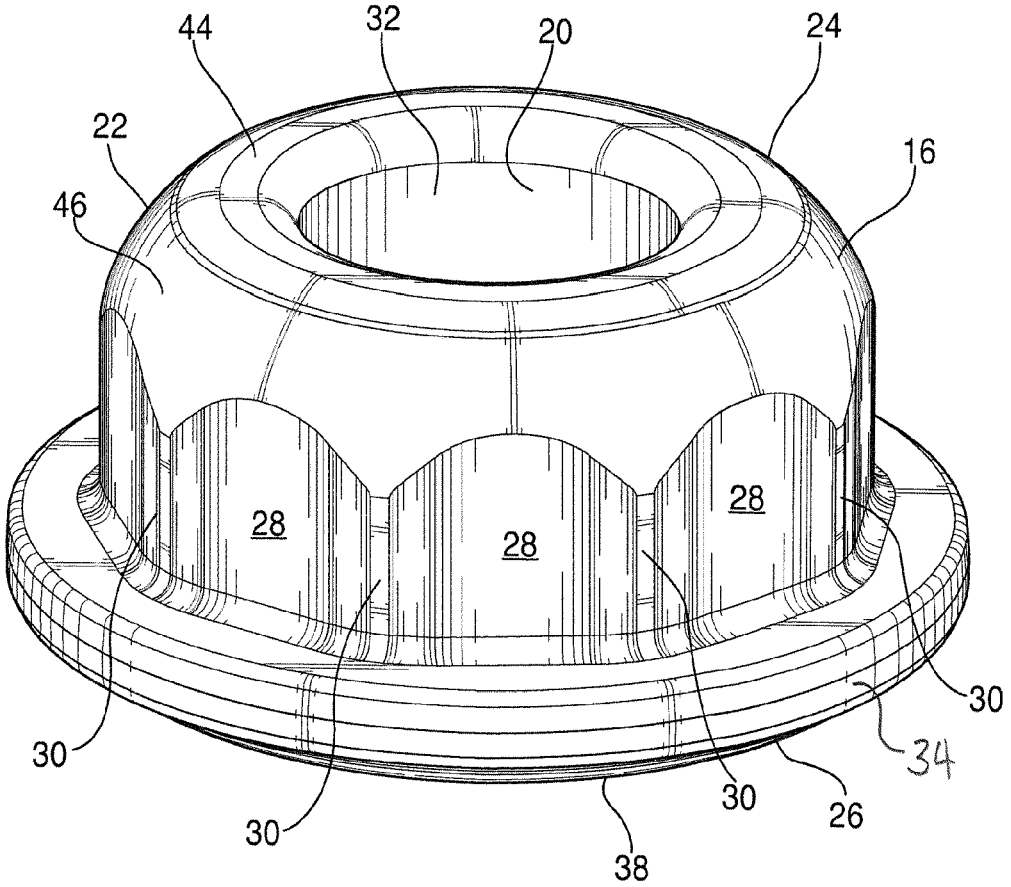
FIG. 2 is a top perspective view of the present faceted bumper of FIG. 1.
Figure 3:
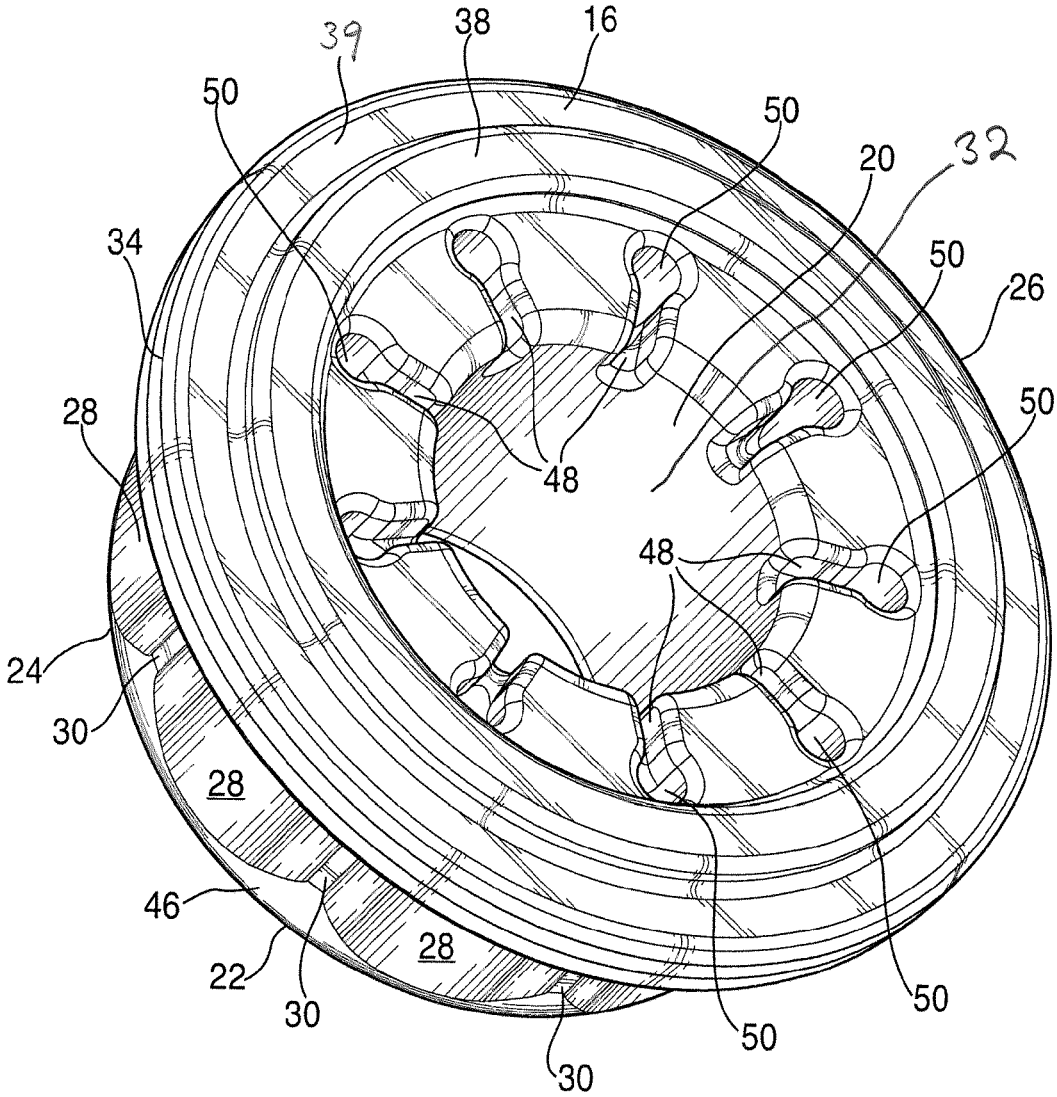
FIG. 3 is a bottom perspective view of the present faceted bumper of FIG. 1.

Referring now to FIGS. 1-3, the present bumper 16 enhances its structural integrity by employing an arrangement of alternating flat and convex surfaces or regions, preferably located around an entire outer periphery of the bumper. In a preferred embodiment, the present bumper 16 includes an inner peripheral surface 20 and an outer peripheral surface 22. It is contemplated that the inner and outer peripheral surfaces 20, 22 are generally cylindrical except at an upper end 24 and a lower end 26 of the bumper 16. The upper end 24 is rounded, arched, or curved as shown, having a convex shape in the direction from which the piston is received. A plurality of flat or faceted regions 28 separated by a plurality of convex regions 30 are disposed on the outer peripheral surface 22 of the bumper 16.

Preferably, the present bumper 16 is made of a resilient or elastomeric material, such as cast polyurethane, in an annular shape, allowing the drive blade 14 to pass through a central opening 32 of the bumper in driving and return strokes of the piston assembly. An annular flange 34 is provided extending outwardly at the lower end 26 of the bumper 16 for fitting between a bottom surface 36 of the cylinder 12 and an annular ring 37 in the nosepiece (FIG. 1), thereby securing the bumper against the cylinder. An annular protrusion 38 is also provided extending outwardly from a bottom side 39 of the bumper 16 for nesting into the annular ring 37 by fitting into an annular recess 40 (FIG. 1) located in a nosepiece 41 located at a lower end of the cylinder 12. A nosepiece seal 42 is located between the bumper 16 and the nosepiece 41, and has a central aperture 43 for slidably accommodating the driver blade 14.

It is preferred that the bumper upper end 24 includes an annular planar middle section 44 disposed between an exterior angled or radiused edge 46 of the bumper 16 and the inner peripheral surface 20. The edge 46 connects the planar middle section 44 with the flat regions 28 and the convex regions 30. As a result, a first diameter of the edge 46 near the upper end 24 is less than a second diameter of the edge near the lower end 26.

Figure 5:
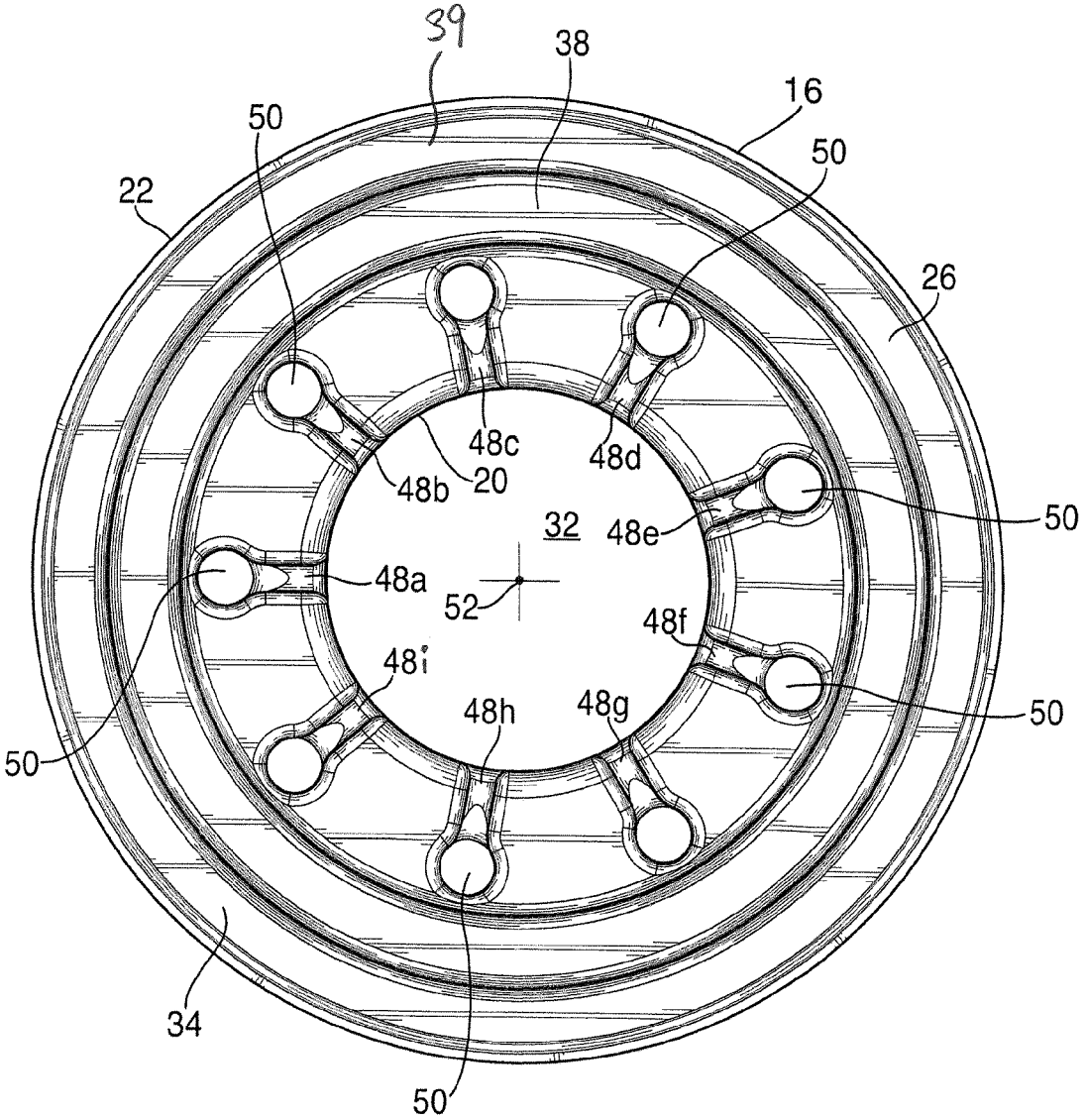
FIG. 5 is a bottom view of the present faceted bumper of FIG. 3.

Referring now to FIGS. 1, 3 and 5, further included in the bumper 16 is a plurality of cooling slots 48 disposed on the bottom side 40 of the bumper arranged in a circumferential direction for cooling the bumper during operation. Each cooling slot 48 extends radially from the inner peripheral surface 20 of the central opening 32, and also extends continuously axially at one end 50 of the radial cooling slot spaced from the inner peripheral surface 20 and toward the exterior angled edge 46 at a predetermined height. In a preferred embodiment, the cooling slots 48 are in fluid communication with the central opening 32, such that air can be drawn from the cylinder 12 to each slot for cooling the bumper during cycling of the piston assembly. A more detailed description of the slots 48 is provided in discussion relating to FIGS. 7 and 8 below.

Figure 4:
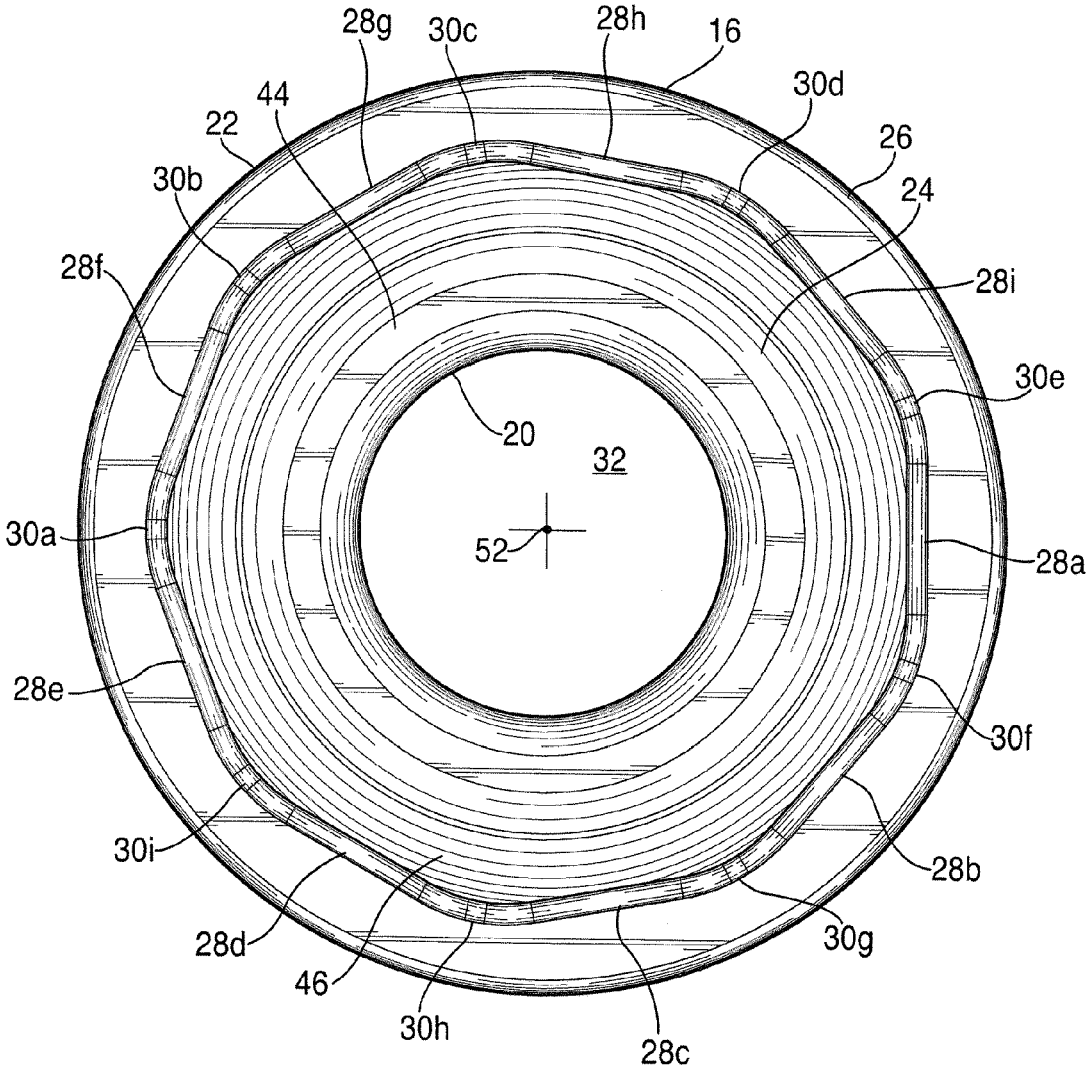
FIG. 4 is a plan view of the present faceted bumper of FIG. 2.

Referring now to FIG. 4, an important aspect of the present bumper 16 is that the plurality of flat regions 28 has an identical total number of regions as the plurality of convex regions 30, where the total number of each region is an odd number. In a preferred embodiment, the bumper 16 has nine flat regions **28*a*-28*i* and nine convex regions 30*a*-30*i* disposed alternatively on the outer peripheral surface 22 of the bumper 16. Although the nine flat regions 28*a*-28*i* and convex regions 30*a*-30*i* are shown for illustration purposes, it is also contemplated that any odd number greater than one can be used for the bumper 16**.

Another important aspect of the present bumper 16 is that because the total numbers of the flat and convex regions **28*a*-28*i*, 30*a*-30*i* are odd numbers, each flat region is disposed directly or diametrically opposite a corresponding convex region across a longitudinal axis 52 of the bumper. As shown in FIG. 4, the flat region 28*a* is disposed directly opposite the convex region 30*a* across the axis 52, and similarly the convex region 30*f* is disposed directly opposite the flat region 28*f* across the axis 52. In this configuration, it has been found that the odd numbers of flat and convex regions 28*a*-28*i*, 30*a*-30*i*** provide an enhanced stress relief by distributing the impact stresses between the regions, and exhibit less fatigue during operation.

Figure 6:
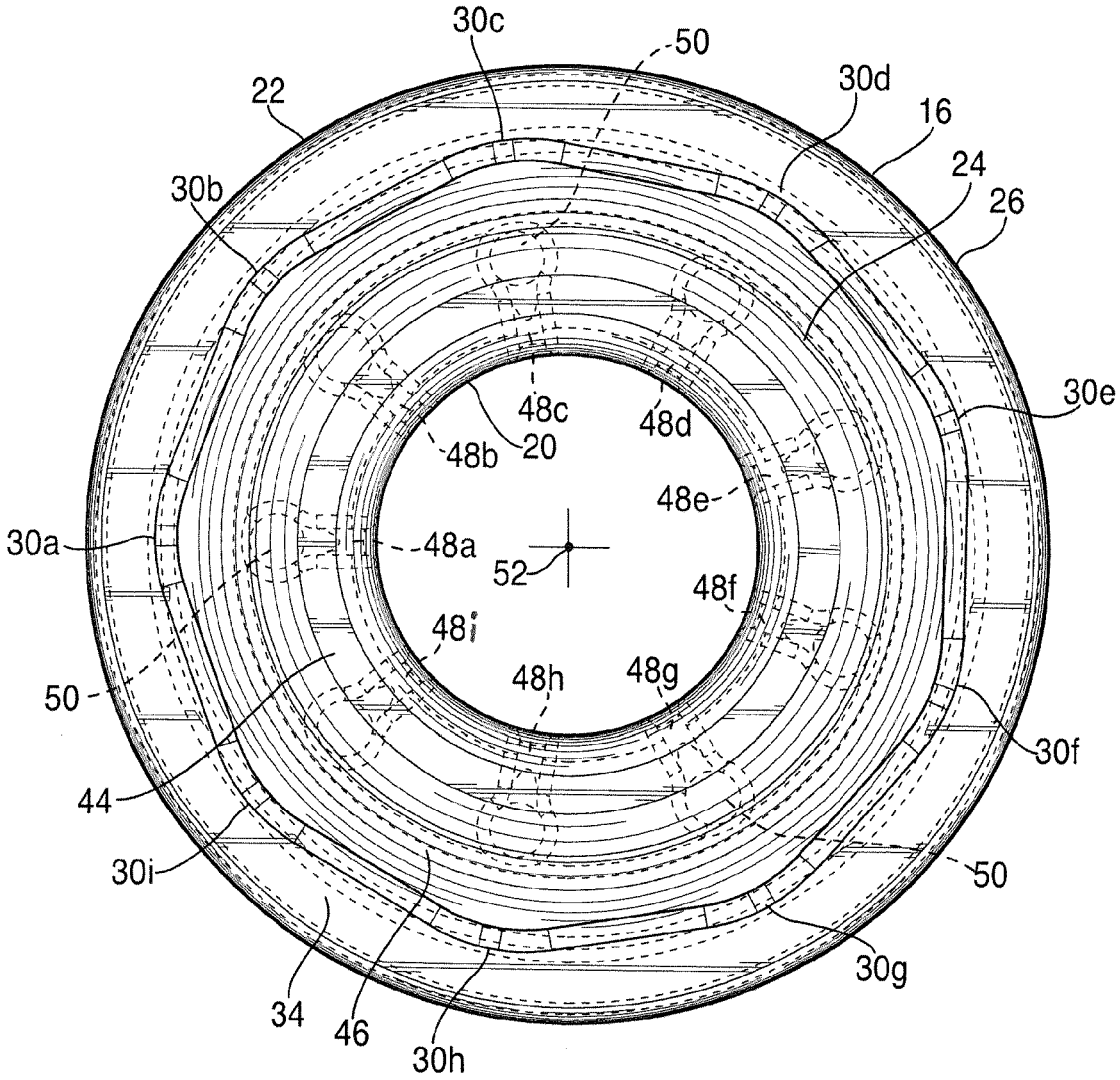
FIG. 6 is an enlarged plan view of the present faceted bumper of FIG. 2, featuring hidden elements located at a bottom portion of the bumper.

Referring now to FIGS. 5 and 6, the cooling slots 48*a*-48*i* are positioned in an identical radial direction with the convex regions 30*a*-30*i* relative to the longitudinal axis 52. As shown in FIG. 6, the plurality of cooling slots 48*a*-48*i* has an identical total number of slots as the plurality of convex regions 30, where the total number of slots, and of regions (counted separately from the slots), is an odd number. As an example, the cooling slot 48*a* and the convex region 30*a* are arranged radially relative to the longitudinal axis 52. The cooling slots 48*a*-48*i* promote internal cooling of the bumper 16 during operation.

Figure 7:
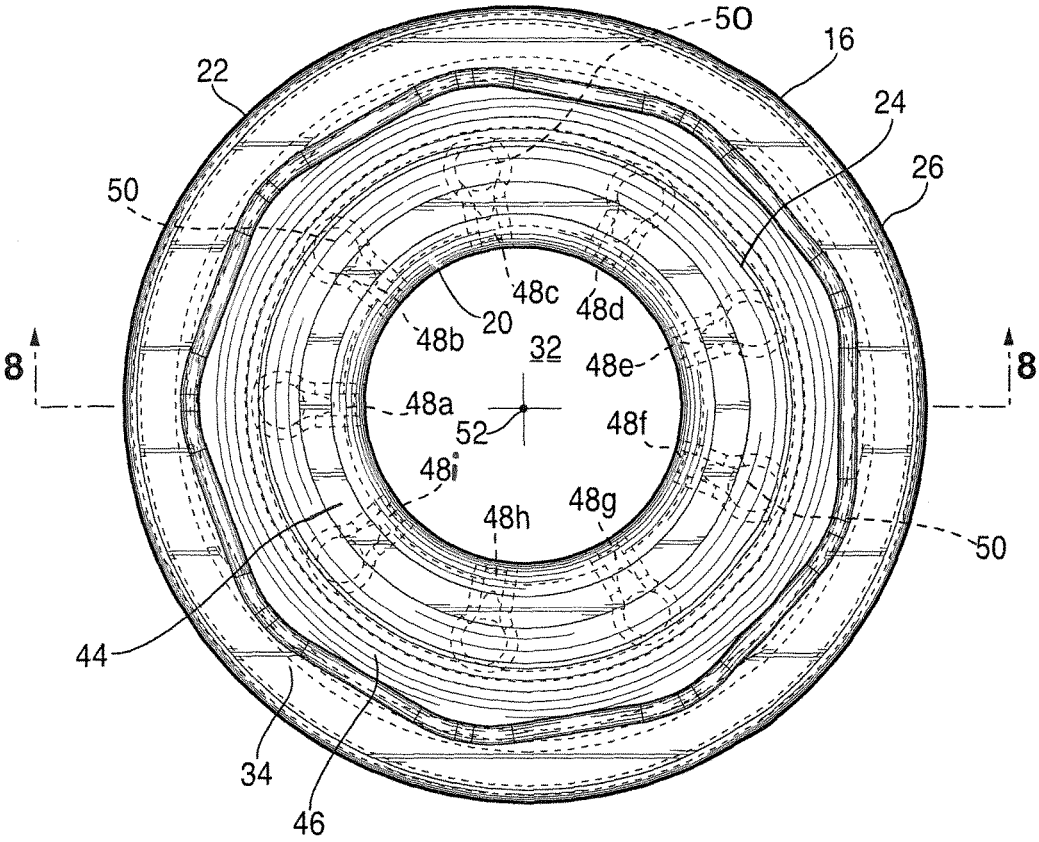
FIG. 7 is a plan view of the present faceted bumper of FIG. 6.
Figure 8:
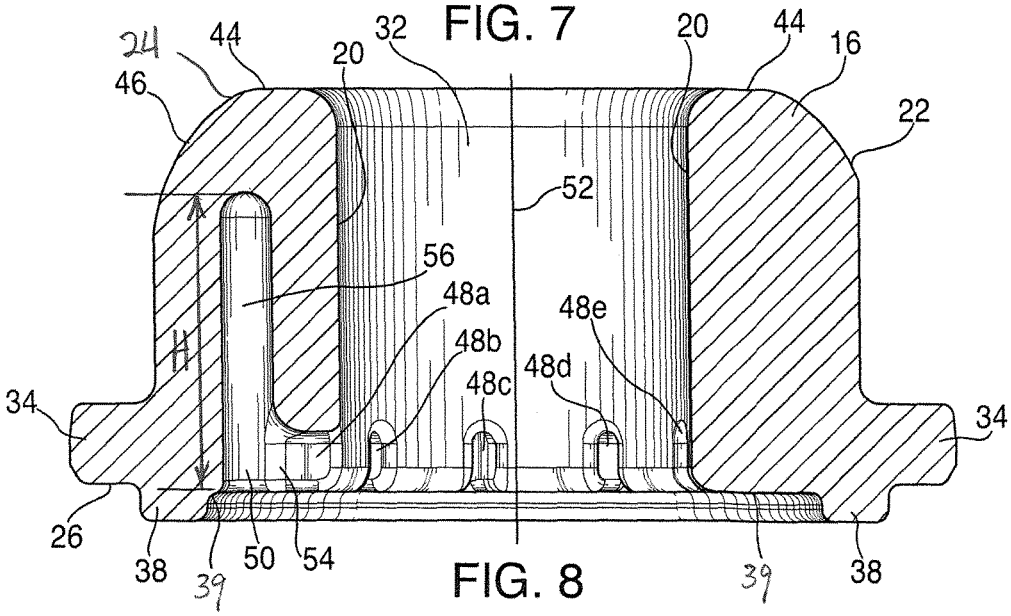
FIG. 8 is a vertical cross-section taken along the line 8-8 of FIG. 7 and in the direction generally indicated.

Referring now to FIGS. 7 and 8, detailed illustrations of the cooling slots 48*a*-48*i* are provided. It is preferred that each slot, e.g. 48*a*, has a horizontal cavity 54 that extends radially from the inner peripheral surface 20 of the central opening 32, and ends near the annular protrusion 38. Also, the slot 48*a* has a vertical cavity 56 in communication with the horizontal cavity 54 and extending continuously axially at one end 50 of the slot spaced from the inner peripheral surface 20 and toward the exterior angled edge 46 and ending at a blind end at a predetermined height H. Preferably, a length of the vertical cavity 56 is greater than the length of the horizontal cavity 54. The geometry of the slots 48*a*-48*i*, preferably cylindrical, may vary to suit the situation. For example, the slots 48*a*-48*i* optionally have curvy, wavy, slanted, straight, inclined, or other suitable shapes of cavities, depending on the application.

Figure 9:
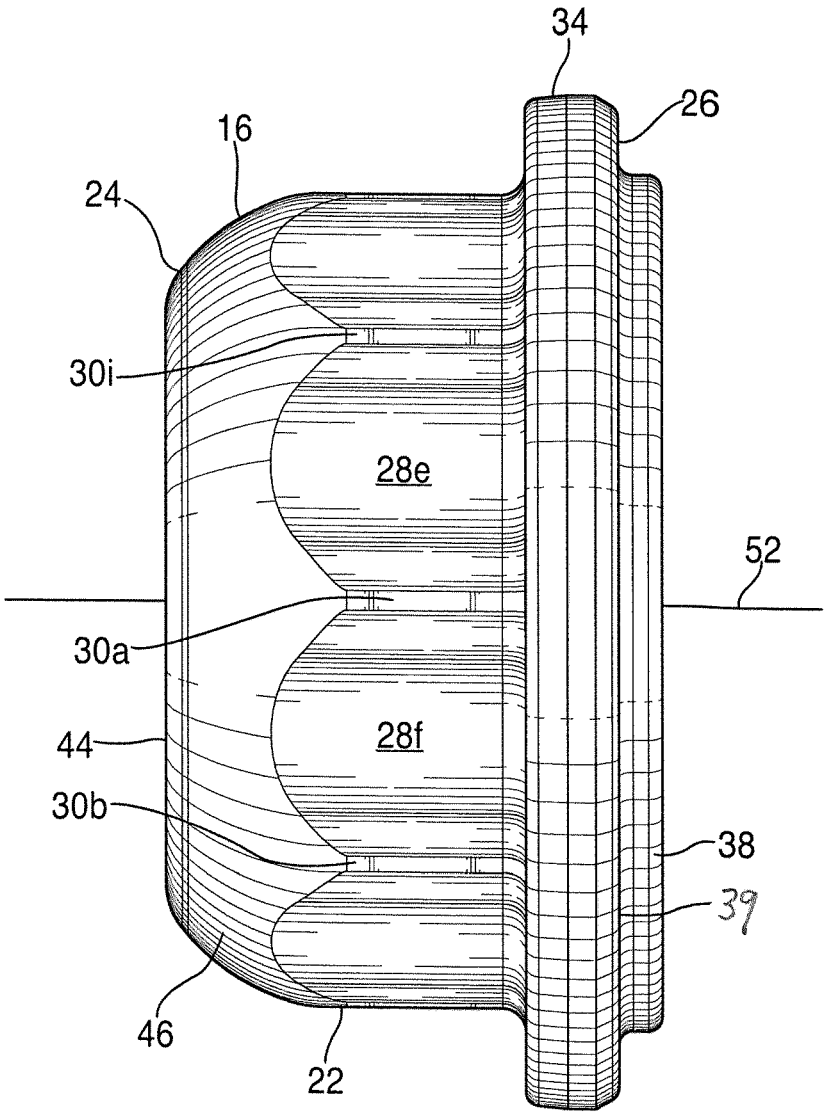
FIG. 9 is a left side view of the present faceted bumper of FIG. 4.
Figure 10:
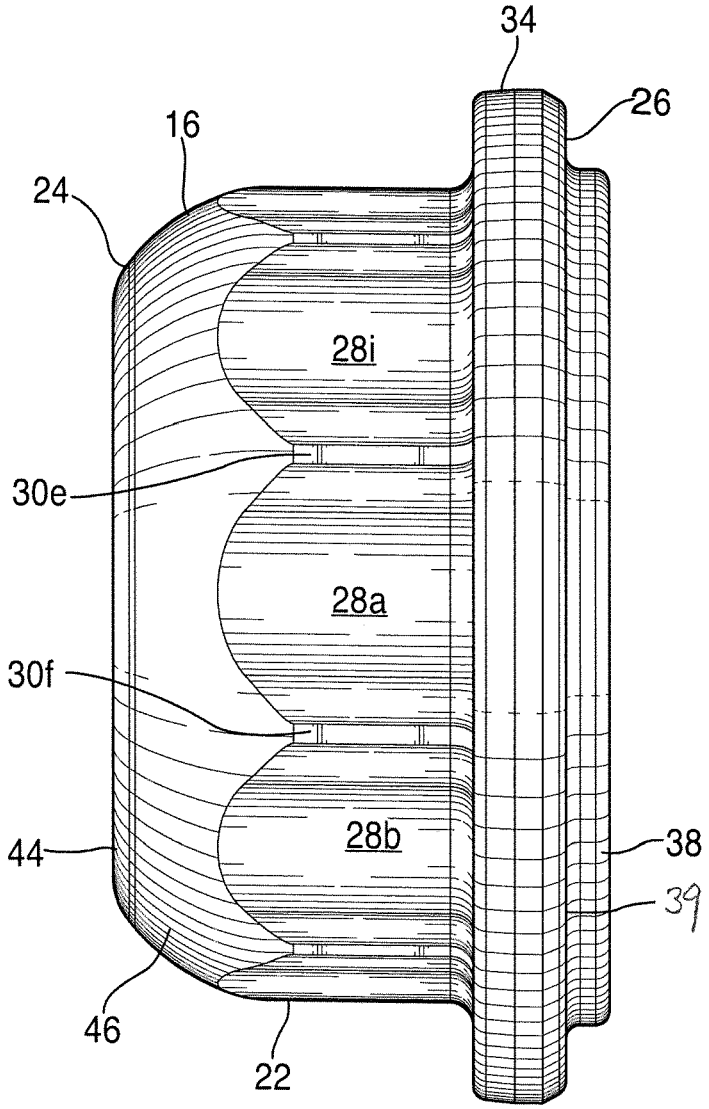
FIG. 10 is a right side view of the present faceted bumper of FIG. 4.

Referring now to FIGS. 4, 9 and 10, a left side of the present bumper 16 (FIG. 4) is shown in FIG. 9, and a right side of the present bumper 16 (FIG. 4) is shown in FIG. 10. Notably, the left side shown in FIG. 9 has the convex region 30*a* at a center of the side view, but the right side shown in FIG. 10 has the flat region 28*a* at the center of the side view. As compared to a conventional bumper, impact-related fatigue relief is achieved by this arrangement of flat and convex regions on opposite sides, e.g., 28*a*, 30*a*. As a result, the fastener driving tool 10 equipped with the present faceted bumper 16 exhibits an improved bumper lifespan considerably.

While a particular embodiment of the present bumper has been shown and described, it will be appreciated by those skilled in the art that changes and modifications may be made thereto without departing from the present disclosure in its broader aspects.

What is claimed is:

1. A bumper sized to fit a cylinder of a fastener driving tool, said bumper comprising a body having: (1) an inner peripheral surface defining a central opening; and (2) an outer peripheral surface on which a plurality of flat regions and a plurality of convex regions are disposed in an alternating pattern, wherein a cooling slot is defined in the body, is in fluid communication with the central opening, and includes a first component and a second component in fluid communication with one another, wherein the first component extends from the inner peripheral surface radially outwardly and the second component extends transverse to the first component such that the cooling slot terminates within the body.

2. The bumper of claim 1, wherein the central opening is sized to slidably receive a drive blade of a piston assembly in driving and return strokes.

3. The bumper of claim 2, wherein the body defines a plurality of cooling slots disposed on a bottom side of the body and circumferentially arranged.

4. The bumper of claim 3, wherein each of said plurality of cooling slots is in fluid communication with the central opening and includes the first component and the second component.

5. The bumper of claim 4, wherein a total quantity of said plurality of cooling slots is equal to a total quantity of said plurality of convex regions.

6. The bumper of claim 4, wherein the second components of said plurality of cooling slots are generally parallel to a longitudinal axis of the body.

7. The bumper of claim 1, wherein the first component of the cooling slot is positioned in an identical radial direction with one of said convex regions relative to a longitudinal axis of said body.

8. The bumper of claim 1, wherein a total quantity of said plurality of flat regions is equal to a total quantity of said plurality of convex regions, the total quantity being an odd number.

9. The bumper of claim 1, wherein the body includes an annular flange extending outwardly at a lower end of said bumper and sized to fit between a bottom surface of the cylinder and an annular ring of a nosepiece to secure said bumper against said cylinder.

10. The bumper of claim 1, further comprising an annular protrusion extending radially outwardly from a bottom of said body and sized to nest into an annular ring of a nosepiece.

11. The bumper of claim 1, wherein each of said plurality of flat regions is disposed directly opposite a corresponding convex region across a longitudinal axis of said body.

12. The bumper of claim 11, wherein a total number of the plurality of flat regions is equal to a total number of the plurality of convex surfaces and is an odd number.

13. The bumper of claim 1, wherein the first component of the cooling slot is generally perpendicular to a longitudinal axis of the body.

14. The bumper of claim 1, wherein the second component of the cooling slot is generally parallel to a longitudinal axis of the body.

15. The bumper of claim 14, wherein the first component of the cooling slot is generally perpendicular to the longitudinal axis of the body.

* * * * *